US007856670B1

(12) United States Patent
Hazuga et al.

(10) Patent No.: US 7,856,670 B1
(45) Date of Patent: Dec. 28, 2010

(54) WEIGHTED ATHLETIC AND THERAPY GLOVE AND METHOD

(76) Inventors: David Hazuga, 226 Ferry St., Eau Claire, WI (US) 54701; Russell Drenth, 1909 Centennial Rd., Decorah, IA (US) 52101

( * ) Notice: Subject to any disclaimer, the term of this patent is extended or adjusted under 35 U.S.C. 154(b) by 0 days.

(21) Appl. No.: 11/559,783

(22) Filed: Nov. 14, 2006

(51) Int. Cl.
*A41D 19/00* (2006.01)

(52) U.S. Cl. ..... 2/160; 2/161.1; 2/163

(58) Field of Classification Search ..... 2/159, 2/160, 161.6, 163, 247, 250, 252, 253; 473/55, 473/59, 207, 212, 219, 226, 256, 422, 437; 482/20, 21, 22, 44, 47, 50, 92, 105; 602/21, 602/22; 128/879, 880
See application file for complete search history.

(56) References Cited

U.S. PATENT DOCUMENTS

| | | | | | |
|---|---|---|---|---|---|
| 2,138,626 | A | * | 11/1938 | Irving | 2/21 |
| 2,522,344 | A | * | 9/1950 | Carmin | 2/160 |
| 3,707,730 | A | * | 1/1973 | Slider | 2/161.1 |
| 3,838,853 | A | * | 10/1974 | Fredenhagen | 482/105 |
| 3,931,647 | A | * | 1/1976 | Dien | 2/161.1 |
| 4,034,979 | A | | 7/1977 | Wester | |
| 4,253,660 | A | | 3/1981 | Tiktin | |
| 4,371,983 | A | | 2/1983 | Piotti, Jr. | |
| 4,684,123 | A | | 8/1987 | Fabry | |
| 4,781,178 | A | * | 11/1988 | Gordon | 602/22 |
| 4,838,546 | A | * | 6/1989 | Winston | 482/105 |
| 4,911,433 | A | * | 3/1990 | Walker et al. | 482/105 |
| 5,004,231 | A | | 4/1991 | Alread | |
| 5,184,815 | A | | 2/1993 | Maddox | |
| 5,386,591 | A | | 2/1995 | Canan | |
| 5,414,868 | A | * | 5/1995 | Crawford | 2/160 |
| 5,517,694 | A | * | 5/1996 | Fabry | 2/161.1 |
| 5,768,710 | A | * | 6/1998 | Williams | 2/161.1 |
| 5,802,615 | A | | 9/1998 | Wenk | |
| 5,848,440 | A | * | 12/1998 | Pajarola | 2/161.1 |
| 5,898,943 | A | * | 5/1999 | Kim | 2/161.2 |
| 6,032,290 | A | | 3/2000 | Lucas et al. | |
| 6,119,271 | A | * | 9/2000 | Byon | 2/161.2 |
| 6,447,464 | B1 | | 9/2002 | Dunlevy et al. | |
| 6,526,592 | B1 | * | 3/2003 | Best | 2/161.1 |
| 6,553,574 | B1 | | 4/2003 | Hall, Jr. et al. | |
| 6,925,653 | B1 | * | 8/2005 | King | 2/21 |
| 6,990,689 | B1 | | 1/2006 | Thellmann | |
| 7,022,095 | B2 | * | 4/2006 | Schneider | 602/64 |
| 7,249,385 | B2 | * | 7/2007 | Schukraft | 2/21 |
| 2002/0184695 | A1 | * | 12/2002 | Fowler | 2/159 |
| 2005/0205100 | A1 | * | 9/2005 | Jensen | 128/880 |

* cited by examiner

*Primary Examiner*—Gary L Welch
*Assistant Examiner*—Sally C Cline
(74) *Attorney, Agent, or Firm*—Anthony J. Bourget; Michael T. Hess

(57) ABSTRACT

A weighted glove comprising a glove having a plurality of finger portions, at least one of the finger portions including at least a first weight member positioned on a back side of the glove, and a strap secured to the at least one of the finger portions. The glove may have a pocket in which the first weight member is positioned, and the weight member may include a generally concaved cross section. A corresponding method of exercising a finger is provided.

21 Claims, 8 Drawing Sheets

WEIGHTED ATHLETIC AND THERAPY GLOVE AND METHOD

BACKGROUND OF THE INVENTION

1. Field of the Invention

The present invention relates generally to gloves, and more specifically to therapy and athletic gloves having weights on the backside of the hand and finger portions.

2. Background Information

Hand and finger strength of an athlete is often an overlooked and underemphasized aspect of athletic skill and training. Having powerful hands and fingers provides a distinct advantage to an athlete in competition, and is often a hidden asset that goes unrecognized by competitors. Importance of hand and finger strength is not confined to professional athletes, but also to amateurs and enthusiasts at all levels. Moreover, the importance of hand strength is significant to the overall well-being of people and to patients in need of treatment for conducting everyday activities.

There are numerous instances where individuals attempt to strengthen the hands and fingers for athletic purposes or for general treatment or rehabilitation. There are also numerous contraptions available intended to assist a person in increasing hand and finger strength. Those contraptions may include many varieties of springs, levers, weights, tension devices and other mechanisms designed to improve the strength of the hands and fingers. Very few, if any, devices are designed to be used during the actual performance of an athletic event or everyday life, but are typically designed to be used during a separate training session conducted apart from the intended athletic event, practice or life activity in general.

Weighted gloves are not uncommon, and have been used by athletes and by others for general rehabilitation and enhancement of abilities. Some weighted gloves for which patents have been granted are shown in the following U.S. Pat. Nos.: 4,911,433 to Walker et al.; 5,184,815 to Maddox; 4,684,123 to Fabry; 6,553,574 to Hall, Jr. et al.; 5,802,615 to Wenk; 5,768,710 to Williams; 5,386,591 to Canan; 3,838,853 to Fredenhagen 4,253,660 to Tiktin. Unfortunately, many of these and other devices are either very complicated, are not practical for use in a variety of actual events or real life situations, or have various deficiencies such as being uncomfortable, poorly fitting, or have other deficiencies.

Particularly troublesome with use of weighted gloves is the tendency for the weighted portions to cause the glove to separate from the fingers. This is especially the case for players of basketball, football, hockey, baseball or other hand sport where a user is catching and throwing a ball or object (or swinging an object) in the normal course of play or practice. There have been few, if any, instances of an effective means for securing weighted elements to the glove while inhibiting sagging or release of the glove from the fingertip portions of the user. Further, there is a need for providing a weighted glove that does not unduly limit a user's range of motion, that is flexible, and at the same time being comfortable and forming a secure glove-fit position.

The present invention provides a novel glove that allows the user to perform normal activities such a playing basketball, tennis, football, hockey or other sport or activities. Advantages include a weighted glove that is comfortable and that does not tend to easily slip off the fingers of the user, which would otherwise distract the user from play and hinder development. Providing such a glove, while allowing the user to go about normal activity or athletic training of the particular event, has significant advantage. Applicants believe use of such weighted gloves will provide the benefit of strengthening the forearms, biceps, shoulders, and overall upper body of the user or athlete and also useful for overall conditioning. Such gloves may be used in combination with other rehabilitation or training exercises and equipment. Weighted gloves may be used during rope jumping exercises, sit-ups, jumping jacks, and other movements. Use of weighted gloves for rehabilitation is desired, and may be used in numerous instances, including but not limited to use in rehabilitation of broken arms, wrists, hands, fingers, and assist in the overall improvement of strength and range of motion. Such gloves allow for a user to stretch and develop muscles and coordination. A user or trainer may alter the location or positioning of weights and flex points about the glove to engineer or assist in specialized developments of the hands, fingers and specialized body parts. Numerous other advantages and novel features of the present invention are disclosed throughout.

SUMMARY OF THE INVENTION

The present invention is directed toward a weighted glove comprising a glove having a plurality of finger portions, at least one of the finger portions including at least a first weight member and a second weight member each positioned on a back side of the glove, at least one of the weight members having a generally concave configuration.

A further aspect of the invention includes a weighted glove comprising a glove having a plurality of finger portions, at least one of the finger portions including at least a first weight member positioned on a back side of the glove, and a strap secured to the at least one of the finger portions.

Yet a further aspect of the invention includes a weighted glove comprising a glove having a plurality of finger portions, at least one of the finger portions including a pocket positioned on a back side of the glove, and at least a first and second weight member positioned within the pocket.

Yet a further aspect of the invention includes a method of exercising fingers comprising providing a glove having at least one finger portion, the at least one finger portion including a first weight member positioned on a back side of the finger portion, placing a finger into the finger portion, and wrapping a strap around a circumference of the at least one finger portion.

The above summary of the present invention is not intended to describe each illustrated embodiment, aspect, or every implementation of the present invention. The figures and detailed description that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
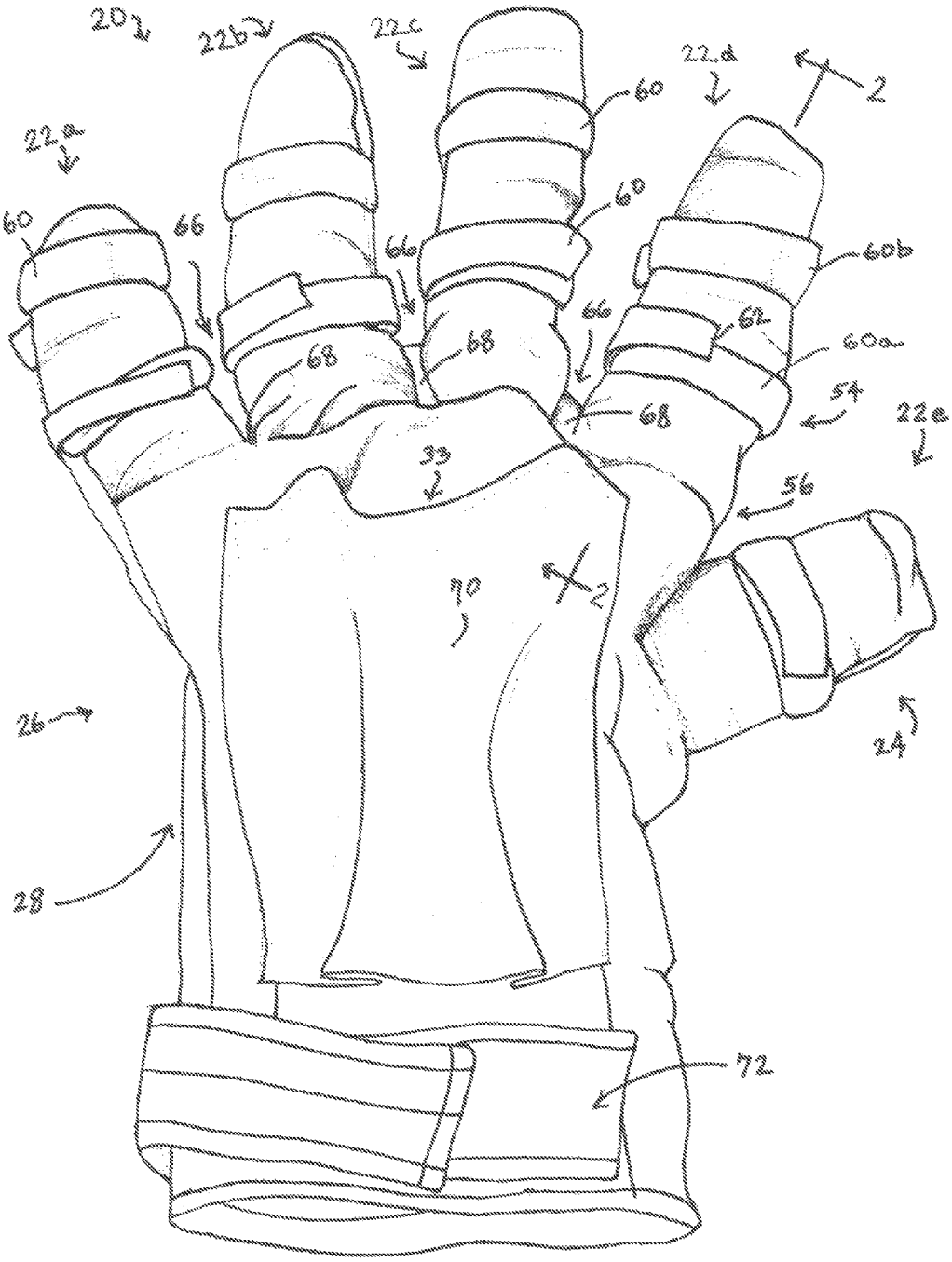
FIG. 1 is a top perspective view of a glove in accordance with the present invention.

While the invention is amenable to various modifications and alternative forms, specifics thereof have been shown by way of example in the drawings and will be described in detail. It should be understood, however, that the intention is not necessarily to limit the invention of the particular embodiments described. On the contrary, the intention is to cover all modifications, equivalents, and alternatives falling within the spirit and scope of the invention and as defined by the appended claims.

DETAILED DESCRIPTION OF THE INVENTION

Referring now to the Figures, a weighted athletic and therapy glove according to the present invention is generally depicted with reference to numeral 20. In one aspect, glove 20 generally comprises a hand portion 26 and preferably a plurality of finger portions 22 as generally shown in FIG. 1. Preferably each finger portion 22, such as at 22*a*, 22*b*, 22*c*, 22*d*, and 22*e*, extends the full length of a finger (finger not shown) to be fitted within each finger portion 22. It may be appreciated that finger portions 22, or some of them, may extend less than the full length of a finger for a desired application. Finger portions 22 also preferably includes a thumb portion 24. Glove 20 also generally includes a back side 28 and a palm side 30.

Figure 2:
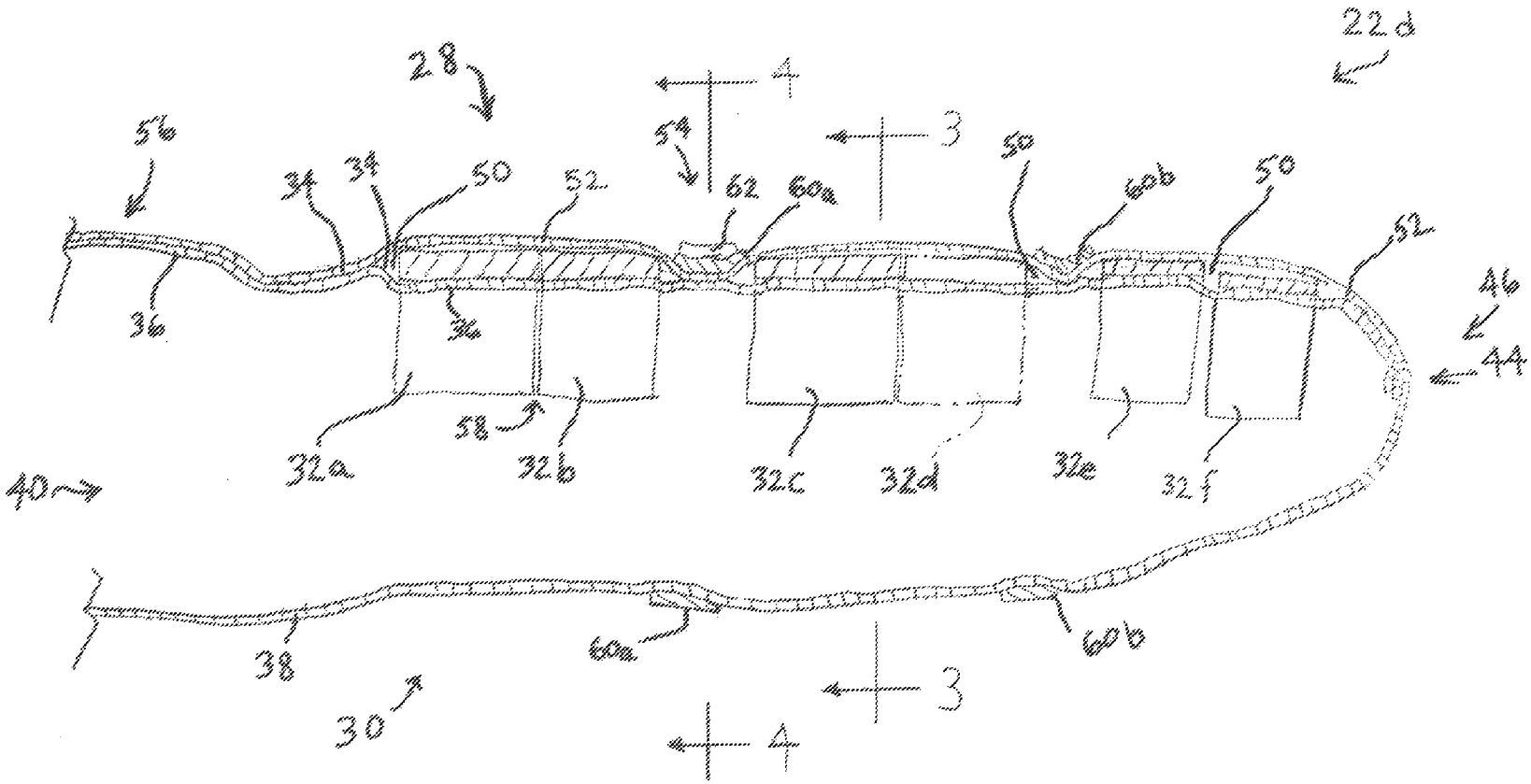
FIG. 2 is a section view taken along line 2-2 of FIG. 1.

Finger portions 22 preferably include weight members 32. Preferably at least one finger portion 22 includes at least one weight member 32. Weight members 32 are preferably positioned on back side 28 of glove 20. With reference to FIG. 2, finger portion 22*d* includes, in one example, at least one weight member 32*a*. It may be appreciated that finger portions 22*a*, 22*b*, and 22*c*, and thumb portion 24 may be of a similar variety as finger portion 22*d*. Preferably multiple weight members 32 are provided on finger portion 22*d*. Weight member 32*a* is positioned on an upper surface 34 of a backside layer 36 of finger portion 22*d*. Upper surface 34 is isolated from contact with a finger to be inserted within portion 22*d*. Preferably backside layer 36 is made of heavy material, such as leather, and it may be appreciated that other materials, including stretch or flex materials) may be used depending on the desired application. Preferably finger portion 22*d* includes a palm side layer 38 positioned generally opposite backside layer 36 and forms the remainder of the finger sleeve 40 in which a finger inserts. Palm side layer 30 is preferably made of a soft and breathable material, preferably a nylon coated foam layer, which also provides for flexibility of motion and light-weight yet durable characteristics. The particulars of the materials to be used for palm side layer may be varied depending on the application. It may also be appreciated that backside layer 36 and palm side layer 38 may be made of the same material. Preferably, however backside layer 36 and palm side layer 38 are stitched together along a generally longitudinal edge 42 of finger portion 22*d*. Thus, a seam 44 may be located around the perimeter of finger portion 22*d*. In such aspect, seam 44 may also be positioned at a finger tip area 46. It may be appreciated that a variety of stitching arrangements are possible and contemplated, and the stitching as shown in the drawings and described herein are representative and not limited thereto.

Finger portion 22 preferably includes a pocket 50 positioned on back side 28, and preferably includes a weight member 32. Pocket 50 may be defined in part by outer surface 52 which may be stitched to backside layer 36. Preferably pocket 50 is stitched so the weight member 32 may not be removed. It may be appreciated, however, that openings or slits may be included within the various layers to accommodate removal of a weight member 32. Pocket 50 is preferably located between the interphalangeal joint 54 of the finger (not shown) and the metacarpophalangeal joint 56 thereof. Preferably pocket 50 includes at least two weight members 32. Preferably weight members 32, such as 32*a*, 32*b*, have the same or similar shapes. Preferably weight members 32*a*, 32*b* abut each other along a slit area 58. Slit area 58 allows weight members 32*a*, 32*b* to flex relative to each other to accommodate a more comfortable fit and flexibility of finger portions 22. Preferably each weight member 32 is allowed to float or adjust to some extent within pocket 50 so that a user may achieve a comfortable and secure position. Preferably adjacent weight members 32*a*, 32*b* are of equal or similar weight and dimension. Preferably additional pockets 50 may be included on a finger portion 22, which in turn preferably hold at least one weight member 32.

Figure 3:
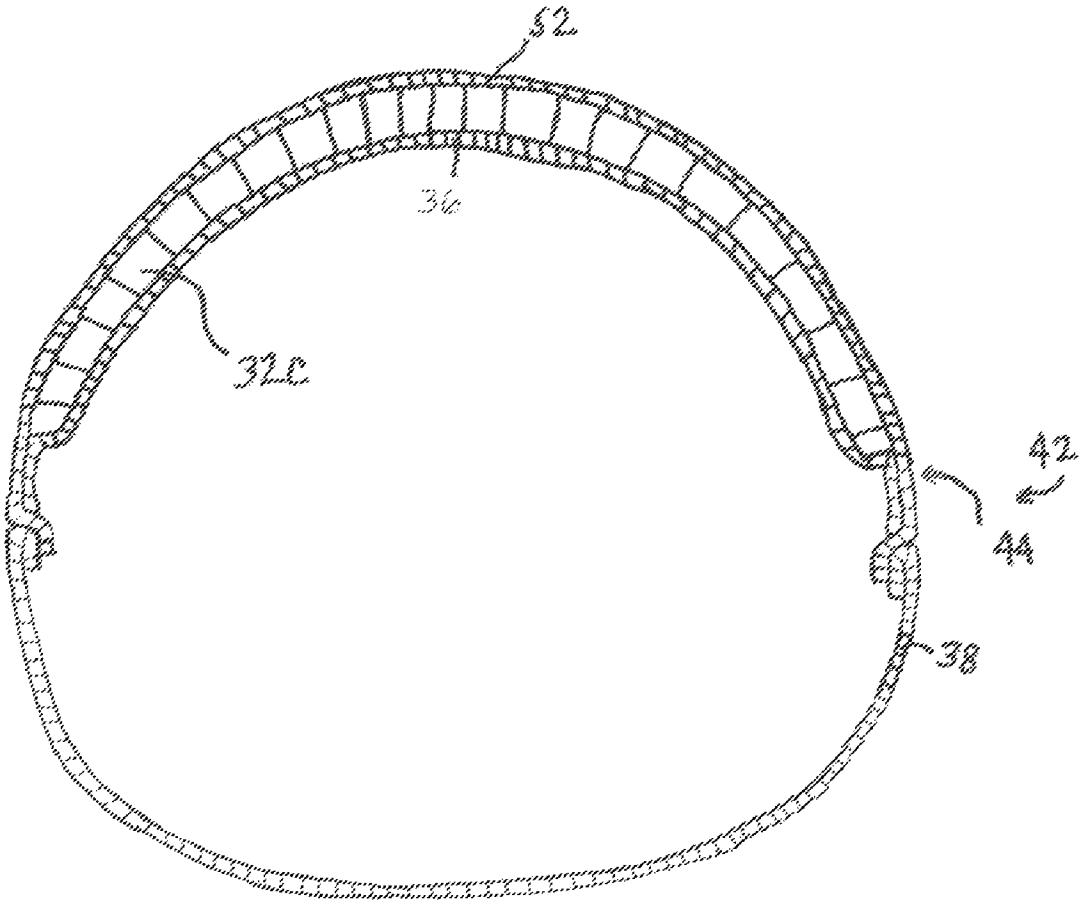
FIG. 3 is a section view taken along line 3-3 of FIG. 2.

As shown in FIG. 3 weight member 32 preferably includes a generally concave configuration. It may be appreciated that the curvature or contour of weight member 32 may vary according to the sizing and preference of the user and the desired application of glove 20. The generally C-shaped cross section of weight member 32 accommodates a convenient fit about the top or dorsal side of a finger and assists with a more secure positioning and holding. It may be appreciated that weight members may extend a greater or lesser extent about the circumference of the finger portion 22 as desired. It is preferable, however, that weight member 32 be no greater than a semicircle in section. Weight members 32 are preferably made of metal. A typical weight member 32 preferably weighs about 1½ ounces. It may be appreciated that weight members 32*e*, 32*f* may be of small dimension to accommodate positioning toward a finger tip area 46 of glove 20. It may also be appreciated that a weight member 32*e*, 32*f* may be selectively removed from finger portion 22 depending on the size of a user's fingers or desired weight specifications. It may be appreciated that weight members 32 may shift and adjust within respective pockets 50, or may be firmly secured in pocket 50 as desired. The stitching tolerances used to form pockets 50 may dictate the degree of freedom of movement of individual or groups of weight members 32. Preferably weight members 32 are located between the knuckles of a user and extend the length of a finger to create a glove of desired weight and flexibility.

Glove 20 preferably includes a strap 60, and preferably multiple straps 60. Preferably strap 60, such as strap 60*a* is secured to at least one of finger portions 22, such as finger portion 22*d*. In one aspect, a first end 64 of strap 60*a* is secured to finger portion 22*d*, and preferably has a loose end 62. Preferably strap 60 covers back side layer 36 of finger portion 22. Strap 60 typically engages outer surface 52. Preferably strap 60 is positioned between weight members 32*a* and 32*c*. Further, as it is understood in the art that all objects have a perimeter, weight members 32 have perimeters. Preferably strap 60 extends generally perpendicular to a longitudinal axis of finger portions 22.

Figure 4:
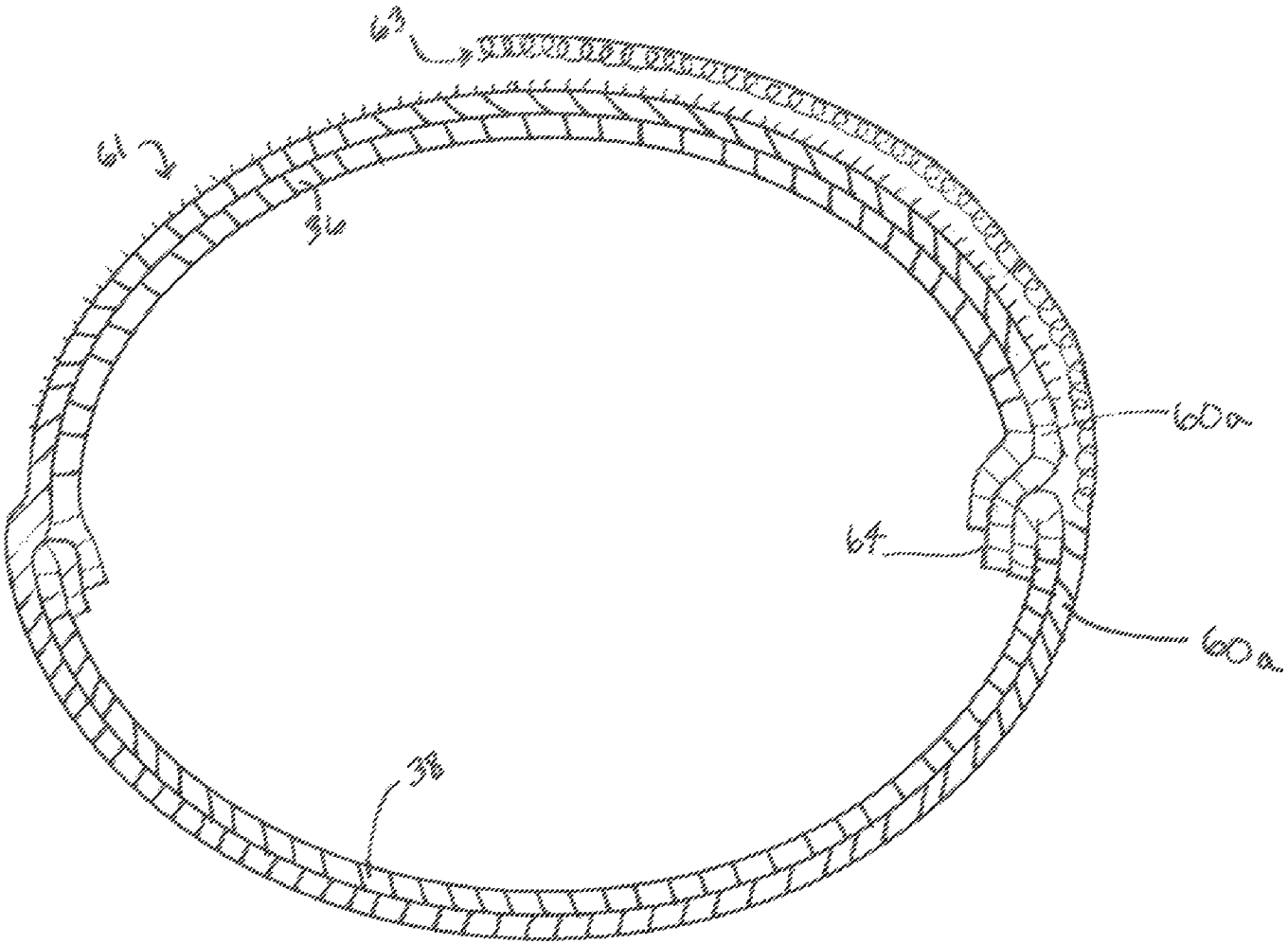
FIG. 4 is a section view taken along line 4-4 of FIG. 2.

In one aspect strap 60 may include a string or fabric or other strap item, or connecting element. Preferably strap 60 includes a hook and loop or hook and pile fastening means, such as the Velcro (trademark) hook and loop fastening device. Preferably strap 60*a* wraps substantially around a circumference of finger portion 22. As shown in FIG. 4, strap 60*a* preferably wraps upon itself (or at least a portion of itself) to utilize the hook and loop characteristics generally as shown. Preferably strap 60*a* includes a first segment having a hook material 61 and a second segment having a loop material 63 to accommodate self wrapping and securing.

Figure 5:
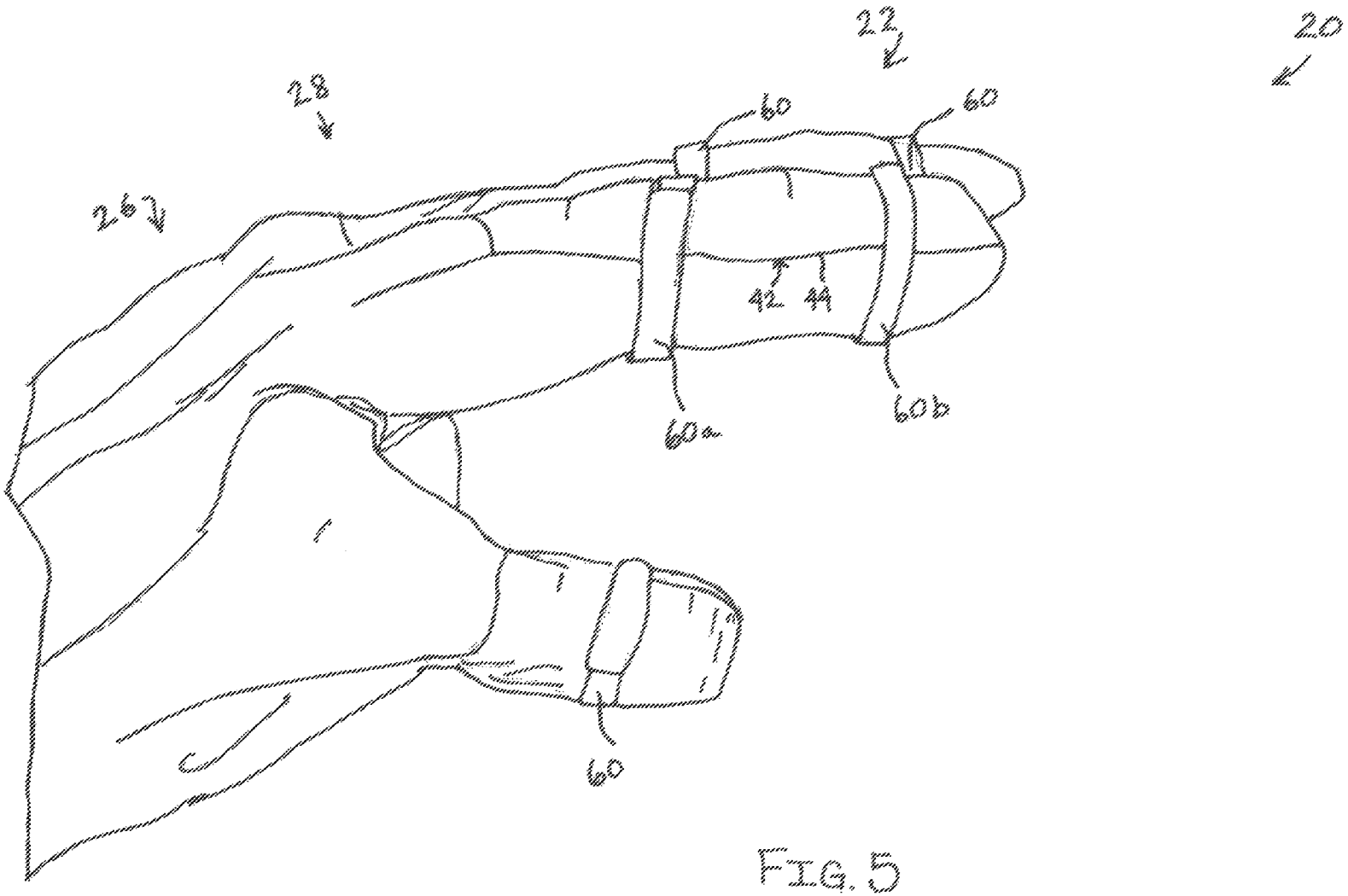
FIG. 5 is a side view of the glove of FIG. 1.
Figure 6:
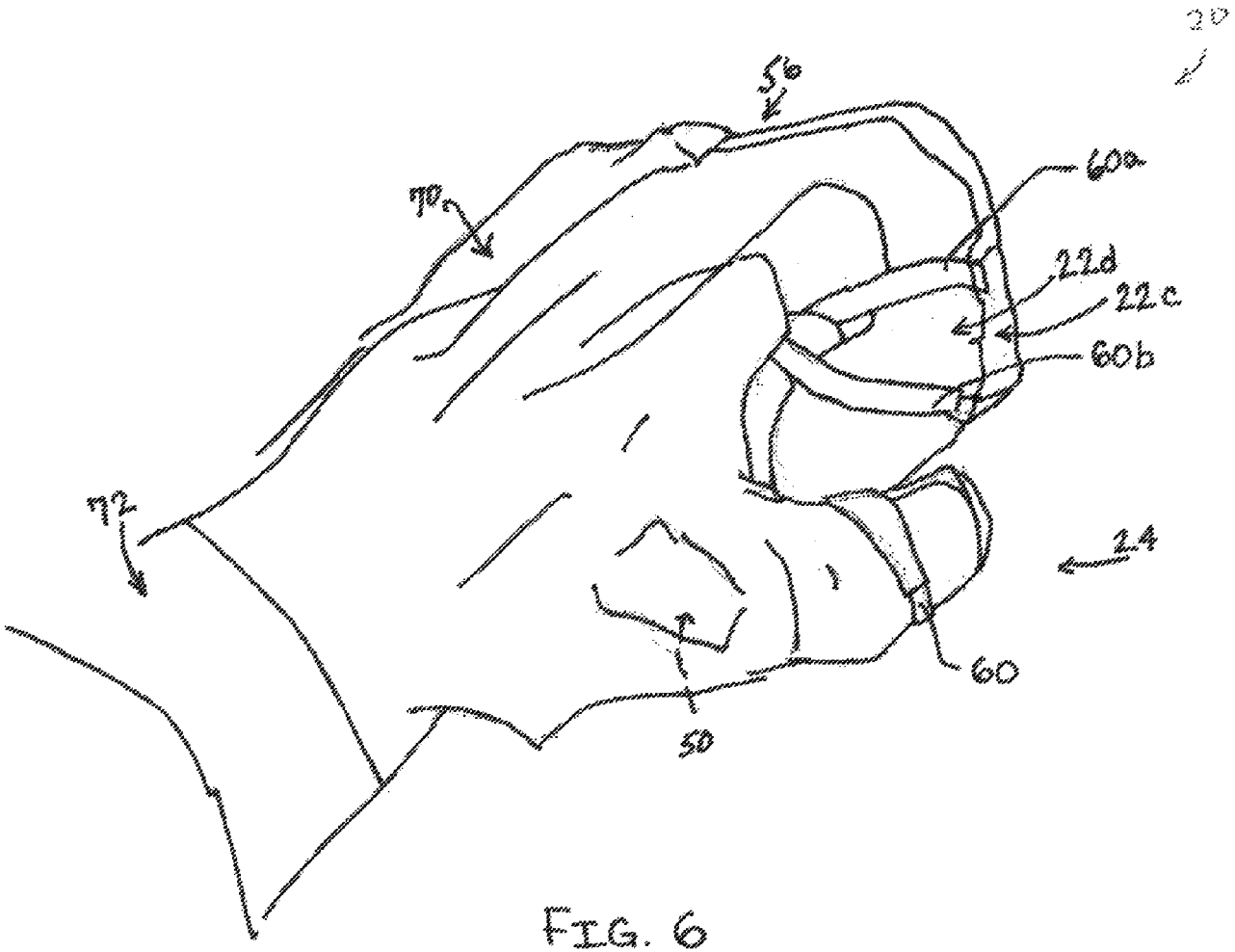
FIG. 6 is a perspective view of a further aspect of the glove of the present invention.

As shown in FIG. 2, strap 60*a* is preferably positioned in the location of a knuckle of a user, such as at the interphangeal joint 54. Strap 60*a* winds around finger portion 22*b* and wraps upon itself. Strap loose end 62 may be lifted to separate the hook and loop aspects of strap 60*a* and may be pressed secure strap 60*a* upon itself in common fashion. As shown with reference to FIG. 5, multiple straps 60 may be secured to respective finger portions. As shown with reference to FIG. 6, a further aspect of the invention is shown where a user is in the act of closing his or her fist within glove 20. Preferably a user may make a fist or modified fist to grasp an object. A further pocket 50 may also be provided to receive a weight member associated with thumb portion 24. Preferably a user would use a glove 20 on each of his or her hands, and it may be appreciated that gloves 20 may be manufactured to fit a variety of users.

In operation a user may pull and/or wind strap 60*a* in tight association around the circumference of finger portion 22*d* and secure strap 60*a* in a set position. Strap 60*a* may be easily readjusted as may be appreciated. Once a user has placed glove 20 on his or her hand (i.e., by inserting all or some of his or her fingers within respective finger sleeves 40 of finger portions 22), the user may push the valley material 68 between finger portions 22 to the valley regions 66 of the glove 20 and hand. Pushing valley material 68 provides for a secure glove-fit positioning so that finger portions 22 less inclined to pull away from the fingers. Advantageously, a user may further secure finger portions 22 in a secure position upon the hand and fingers by winding straps 60 around finger portions 22. Winding straps 60 especially around the knuckles (whether directly over the knuckle region, or preferably slightly toward the valley region 66 of the glove) applies a secure holding of finger portion to inhibit slipping of finger portion off of the finger. Such strap 60 is especially advantageous given the increased weight of finger portions given the presence of the weight members 32.

Figure 8:
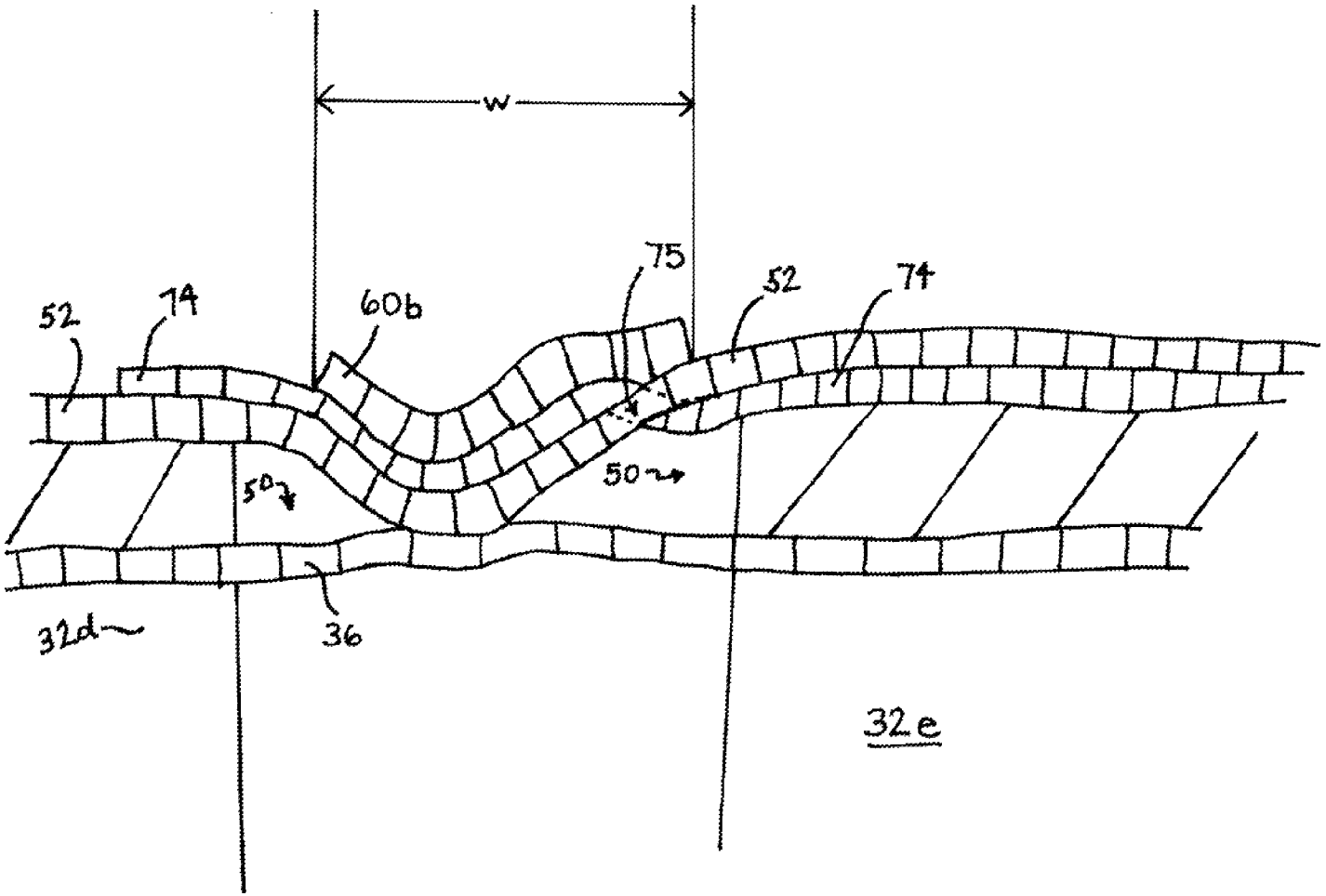
FIG. 8 is a section view taken along box 8 of FIG. 7.

Use of multiple straps 60*a*, 60*b*, having a width W, on a single finger portion 22 further enhances the secured fit where each strap 60*a*, 60*b* operates about a respective knuckle region of the finger to inhibit slipping of finger portion 22. As seen in FIG. 8, weights 32*d*, 32*e*, having respective perimeters, create a space between the perimeters of each respective weight 32*d*, 32*e* (the space is not labeled) and strap 60*b*, having width W, lies substantially within this space. Preferably, the total width W of strap 60 lies within the space (i.e., the area outside the perimeters of weight members 32).

Glove 20 may also include a back pocket 70 positioned on glove at back side 28, in which a further weight member 33 is situated. Weight member 33 may be selectively removed from pocket 70. Weight member 33 may be of a variety of configurations, including but not limited to a square, rectangle, circle, oval, etc. Multiple weight members 33 may also be situated in back pocket or pockets 70 as desired. Pocket 70 preferably includes a hook-and-loop strip for convenient opening to accommodate selective removal of weight member 33. Glove 20 preferably includes wrist strap 72 which wraps around the circumference of glove 20 at a wrist location of a user. Strap 72 preferably includes hook-and-loop fastening mechanism to assist in securing glove 20 to a user's hand/wrist.

Figure 7:
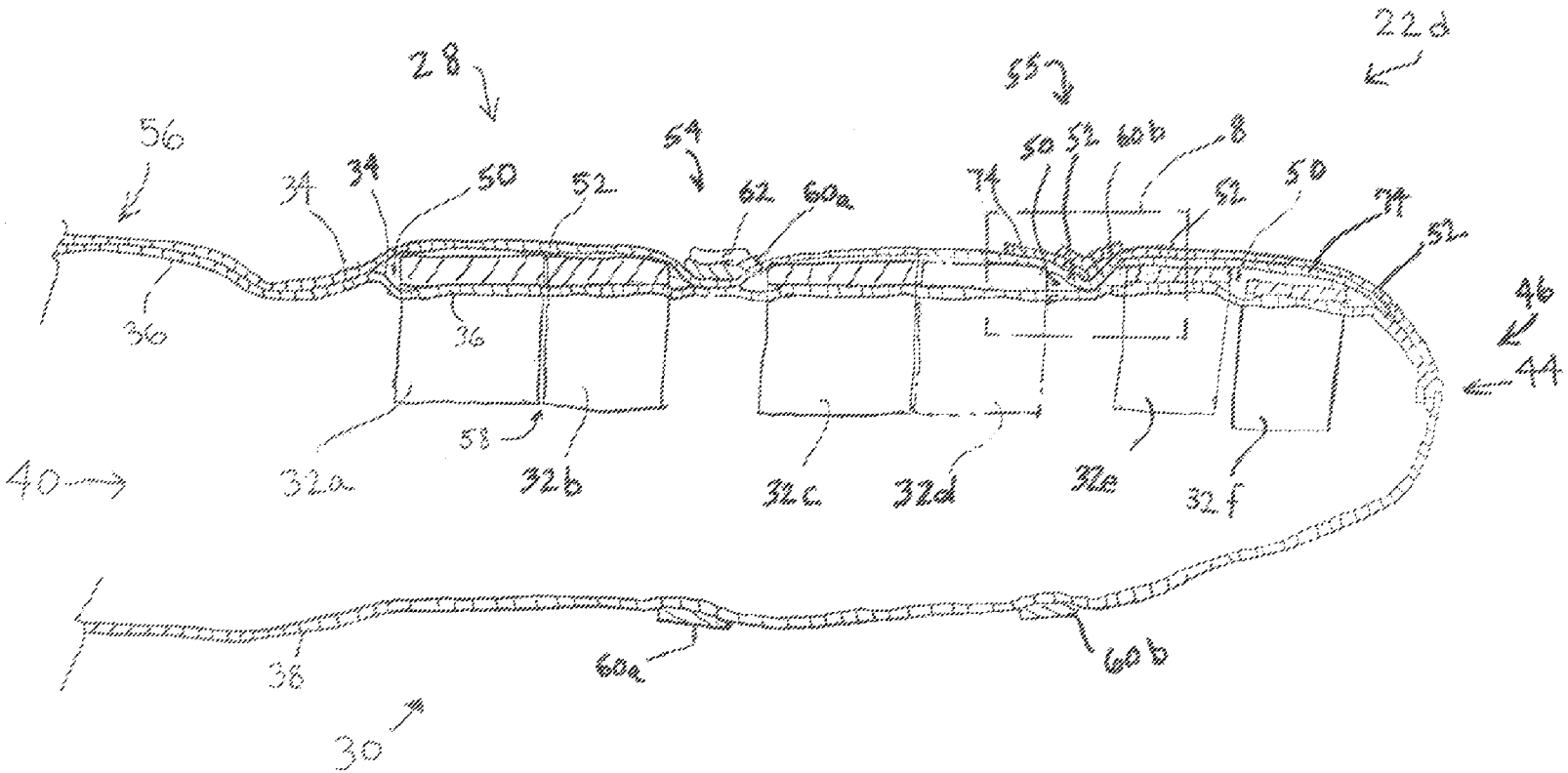
FIG. 7 is a section view of a further aspect of the present invention.

FIG. 7 and FIG. 8 show a further aspect of the invention, where strip 74 is provided. Strip 74 is preferably a flexible or elastic strap 74, and more preferably an elastic string or band. Strip 74 preferably has one end connected to finger portion 22 at finger tip area 46, with an opposite end connected at a position below the joint, such as below distal interphalangeal joint 55. Strip 74 preferably lies beneath outer surface 52 and may run the length of finger portion 22, or may be positioned upon outer surface 52 at any preferred point along the way. As shown in FIG. 7, in one instance elastic strip 74 extends through hole 75 of outer surface 52. The elastic action of strip 74 tends to retract the outer portion of finger portion 22. It may be appreciated that strip 74 may be affixed to outer surface 52 at positions closer to hand, such as below knuckle at interphalangeal joint 54 or below metacarpophalangeal joint 56. Hole 75, or other similar holes 75 contained at different positions along outer surface 52 may be optionally used for such positioning. It may also be appreciated that strip 74 may be positioned within finger sleeve 40 and run along the dorsal side, extending from tip area 46 to a point closer to hand. In such case suspension elements (not shown) may be used to suspend strip 74 to or from backside layer 36 at desired positions. It may be appreciated that multiple strips 74 may be configured on a finger portion 22. It may be further appreciated that strip 74 may have a free end (not shown) such that free end of strip 74 may be secured to finger portion 22 (or hand portion 26) after securing of strap 60 (i.e., so as to not limit the elastic action of strip 74 to region above the knuckle. Multiple strips 74 may be used to help further resist finger portion 22 from separating or sagging from a finger inserted within finger sleeve 40. Preferably strip 74 is connected to hand portion 26 to realize greatest elastic action. Strip 74 may travel through (or weave through) a series of holes, such as at hole 75, as desired depending on the application. Such holes, such as at hole 75, may be included on outer surface 52, backside layer 36, or other layers of finger portion 22 or hand portion 26. It may be appreciated that strip 74 may also include a hook or loop feature for releasably securing strip 74 to a position on glove 20 as desired, prefereably toward hand portion 26.

A further aspect of the invention includes a method of exercising fingers as may be appreciated with reference to the Figures and the elements described above. A glove 20 is provided which has at least one finger portion 22 which includes at least a first weight member 32 positioned on a back side 28. A user places a finger (not shown) into finger portion 22 (i.e., into finger sleeve 40), and then wraps strap 60 around a circumference of finger portion 22. Preferably a second weight member 32 is provided and the strap 60 is attached, at least at one end thereof, to finger portion 22. Use of a hook and loop securing means is preferred. Preferably weight member 32 is contoured to match a contour of an inserted finger, and is typically C-shaped. Weight member 32 is preferably positioned within a pocket 50. Preferably finger portion 22 extends a length to cover an entire finger of a user.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated.

What is claimed is:

1. A weighted glove comprising:

a glove having at least one finger portion and at least another finger portion;

said at least one finger portion including at least one weight member positioned on a back side of said at least one finger portion and positioned so as to not extend across an interphalangeal joint area of said at least one finger portion;

said at least another finger portion including at least another weight member positioned on a back side of said at least another finger portion;

at least one strap secured to and overlapping and wrappable completely around a portion of said at least one finger portion;

at least another strap secured to said at least another finger portion.

2. The glove of claim 1 where said at least a part of said at least one finger portion comprises a flexible material positioned substantially around a circumference of said at least one finger portion and were said strap wraps around said flexible material.

3. The glove of claim 1 further comprising at least a further weight member positioned on a back side of said glove.

4. The glove of claim 1 where said at least one strap extends generally perpendicular to a longitudinal axis of said at least one finger portion.

5. The glove of claim 4 where said strap includes one from the group comprising a hook fastener element, a loop fastener element, and an adhesive.

6. The glove of claim 1 where said at least one strap has a length sufficient to wrap said strap substantially beyond the circumference of said at least one finger portion.

7. The glove of claim 1 where said at least one strap is wrapped around a circumference of said at least one finger portion, said at least one finger portion further including a strip which extends over at least one knuckle region of said at least one finger portion.

8. The glove of claim 1 further comprising at least a further finger portion having a strap which wraps around a flexible material at the circumference of said further finger portion.

9. The glove of claim 1 further comprising at least a further weight member positioned on a back side of said glove, said at least one strap secured between said at least one weight member and said at least a further weight member.

10. The glove of claim 9 where said strap is secured between an interphalangeal joint area and a metacarpophalangeal joint area of said finger portion.

11. A weighted glove comprising:

a glove having a plurality of finger portions;

at least one of said finger portions including at least one weight member positioned on a back side of said finger portion;

at least another weight member positioned on a back side of said glove;

wherein said at least another weight member is positioned on a back side of said finger portion, a strap secured to and overlapping a portion of said at least one finger portion, said strap having at least one end releasingly secured to said finger portion; and substantially all of a width of said strap lies within a space defined by a perimeter of said at least one weight member and a perimeter of said at least another weight member.

12. The glove of claim 11 where at least a part of said at least one finger portion comprises a flexible material positioned substantially around the circumference of said finger portion; and said strap wraps around said flexible material and the circumference of said finger portion.

13. The glove of claim 11 where said at least another weight member is positioned between a metacarpophalangeal joint area and an interphalangeal joint area of said glove.

14. The glove of claim 11 where said strap contacts a flexible back side layer of said finger portion.

15. The glove of claim 11 where said strap wraps around a circumference of said at least one finger portion between a metacarpophalangeal joint area and an interphalangeal joint area of said glove.

16. The glove of claim 11 where said at least one finger portion includes a pocket on said back side and where said at least one weight member and said at least another weight member are positioned in said pocket.

17. The glove of claim 11 where said at least one weight member and said at least another weight member are each positioned on said finger portion between a metacarpophalangeal joint area and an interphalangeal joint area of said glove.

18. A weighted glove comprising:

a glove having a plurality of finger portions;

at least one of said finger portions including a pocket positioned on a back side of said glove, said pocket positioned between an interphalangeal joint area and an adjacent joint area of said at least one finger portion;

at least one weight member and at least another weight member positioned within said pocket; and a strap secured to and overlapping a portion of said at least one finger portion, said strap having at least one end releasingly secured to said finger portion.

19. The glove of claim 18 where said at least one weight member and said at least another weight member each have a generally C-shaped cross section and abut each other within said pocket.

20. The glove of claim 18 where substantially all of a width of said strap secured to said at least one finger portion lies outside a perimeter of said at least one weight member and a perimeter of said at least another weight member.

21. A weighted glove comprising:

a glove having at least one finger portion;

said at least one finger portion including at least one weight member positioned on a back side of said at least one finger portion;

at least one strap secured to said at least one finger portion between an interphalangeal joint area and a metacarpophalangeal joint area of said finger portion, said strap overlaps a portion of said at least one finger portion and contacts a flexible back side layer of said finger portion, said strap having a length and width, said length being longer than said width and extending generally perpendicular to a longitudinal axis of the at least one finger portion.

* * * * *